US006470633B2

(12) United States Patent
Showen

(10) Patent No.: US 6,470,633 B2
(45) Date of Patent: Oct. 29, 2002

(54) CIRCULAR SUBDIVISIONS

(76) Inventor: Robert Harrison Showen, 1131 Running Springs #3, Walnut Creek, CA (US) 94595

( * ) Notice: Subject to any disclaimer, the term of this patent is extended or adjusted under 35 U.S.C. 154(b) by 0 days.

(21) Appl. No.: 10/011,945

(22) Filed: Dec. 5, 2001

(65) Prior Publication Data

US 2002/0108346 A1 Aug. 15, 2002

Related U.S. Application Data

(60) Provisional application No. 60/255,667, filed on Dec. 13, 2000.

(51) Int. Cl.[7] ..... E04B 1/00

(52) U.S. Cl. ..... 52/169.1; 52/169.2; 52/169.3; 52/750; D25/4; D25/31

(58) Field of Search ..... 52/169.1, 169.2, 52/169.3, 741.1, 750, 33; D25/3, 4, 31

(56) References Cited

U.S. PATENT DOCUMENTS 4,575,977 A * 3/1986 Taylor ..... 52/169.3
4,679,363 A * 7/1987 Adams ..... 52/169.3
4,852,313 A * 8/1989 Jones ..... 52/169.3
5,671,570 A * 9/1997 Kaufman et al. ..... 52/169.2

* cited by examiner

*Primary Examiner*—Carl D. Friedman
*Assistant Examiner*—Jennifer I. Thissell

(57) ABSTRACT

A subdivision system providing alternating one-way traffic on all subdivision streets, said system comprising, a plurality of traffic circles, each traffic circle having a traffic lane surrounding the traffic circle, a plurality of development circles, each development circle containing one or more buildings, each development circle having an inner parking lane, and an outer traffic lane, surrounding the development circle, the rotational direction of traffic flow around a traffic circle being opposite to the rotational direction of traffic flow around a development circle, wherein certain parts of the traffic lane of each traffic circle overlap certain parts of the traffic lanes of at least two immediately adjacent development circles, and wherein said certain overlapping parts of the traffic lanes of the traffic circles, and the opposite rotational directions of traffic flow around the traffic circles and around the development circles, provide alternating one-way traffic on all subdivision streets.

14 Claims, 6 Drawing Sheets

CIRCULAR SUBDIVISIONS

CROSS-REFERENCE TO RELATED APPLICATIONS

U.S. Provisional Patent Application No. 60/255,667, filed Dec. 13, 2000, entitled "Offset Star Construction Circular Street Subdivision". The reference to "Offset Star Construction" has been deleted from the title of this application because it is just one of many forms of construction usable in CIRCULAR SUBDIVISIONS® and so far as residential construction is concerned single-family detached homes are still the predominant choice.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The field of endeavor to which my invention pertains is real estate subdivision and development, with references to appropriate residential, office, commercial and industrial construction techniques.

I hired a patent search company to investigate prior art and they concluded that the following U.S. patents were most relevant to my disclosure:

U.S. Pat. No. 4,679,363 discloses a township, city and regional land arrangement with housing and commercial buildings having a plurality of circular roadways.

U.S. Pat. No. 4,920,711 discloses a building construction system which is arranged in four 90 degree quadrants.

U.S. Pat. No. 4,852,313 discloses a building arrangement and method for view site; said arrangement maximizes the number of houses with a line of site to a view.

None of the foregoing patents, however, remotely approximate the combination of development circles, surrounded by traffic circles, all connected together by a pattern of one-way streets, that is the subject matter of this application.

At the present time most residential subdivisions today are linear, consisting of rectangular blocks of narrow rectangular lots;

That force the adjacent homes to be parallel and jammed close together with minimal side yards;

That provide very little, usually just one, front street guest parking space and that force the home's garage doors to face directly on to the front street;

That require the developer to install large storm drains ultimately discharging into rivers or bays and that sometimes require the developer to install perpendicular bumps to limit vehicular speeds because the two-way streets are wide, long and straight.

Similar problems exist in office, commercial and industrial subdivisions.

BRIEF SUMMARY OF THE INVENTION

CIRCULAR SUBDIVISIONS® residential subdivisions eliminate virtually all of the problems described above with respect to linear subdivisions. In a CIRCULAR SUBDIVISIONS® single-family detached home residential subdivision:

There are only four homes on each development circle and each home faces 90 degrees away from the home on either side of it. Even for a minimal 5,000 square foot lot the street frontage is over 125 feet. There is room for four front street guest parking spaces and the garage doors are on the side, not the front, of the home.

The streets are one-way only, which helps to reduce the developer's costs of land, grading, paving and draining for the streets; and The streets are all circular, which automatically limits the speeds of cars and trucks and would reduce deadly automobile accidents by about 90 percent according to a recent report published in the April 2001 issue of the American Journal of Public Health.

Similar advantages apply to office, commercial and industrial subdivisions, as explained later in this Specification.

DETAILED DESCRIPTION OF THE INVENTION

1. The Concept

Figure 1:
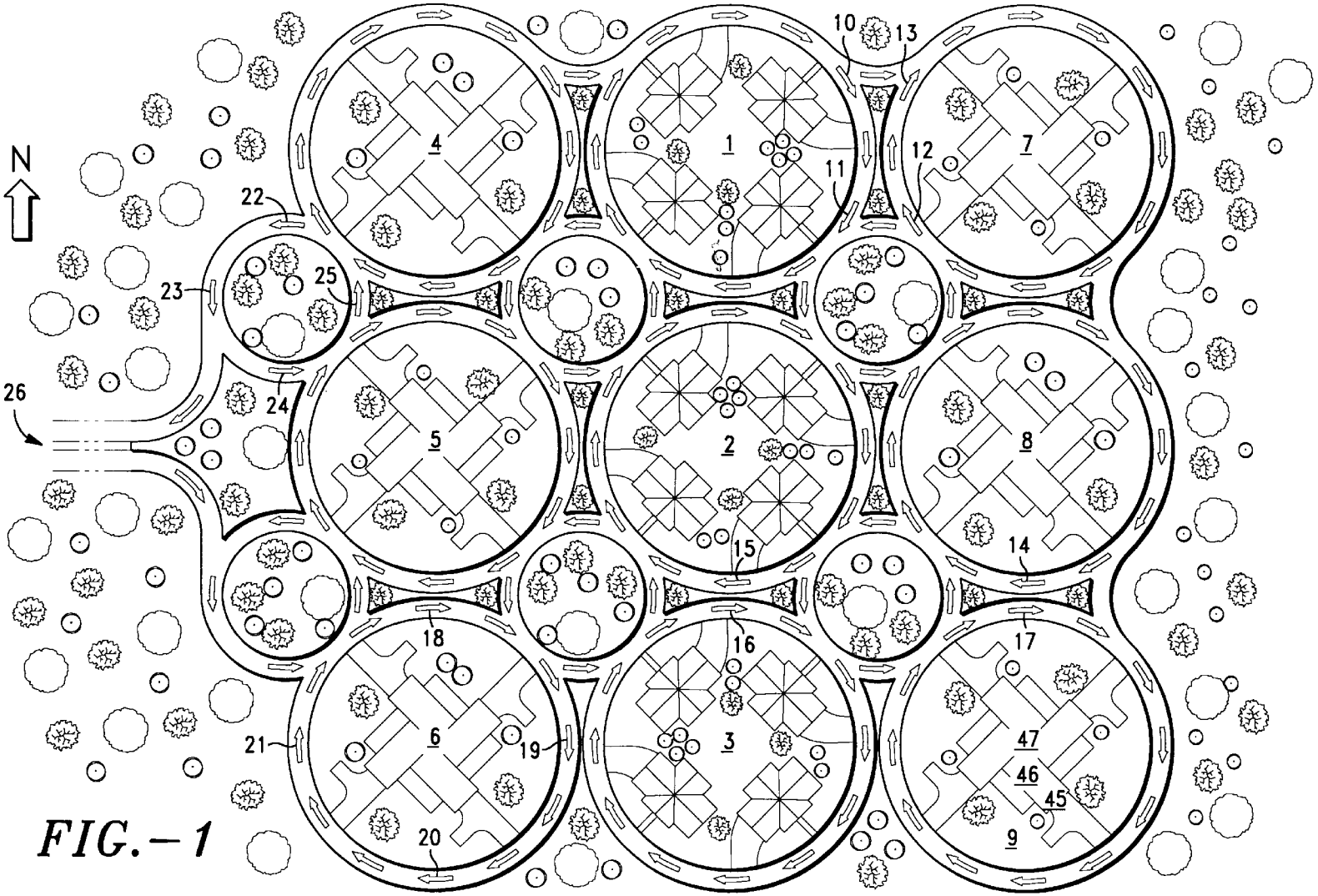
FIG. 1—Depicts a scale model of a typical Circular Subdivision®.

As shown in FIG. 1, a picture of applicant's architectural scale model, all streets in CIRCULAR SUBDIVISIONS® are one-way and circular (circles, ovals, polygons). In the example depicted in FIG. 1 the larger circles, referred to as development circles, have a diameter of about 200 feet and the smaller circles, referred to as traffic circles, have a diameter of a little less than 100 feet. Each of the development circles, and the traffic circles, and the exterior edges of the subdivision, contain trees and other natural plantings to provide screening. The traffic circles also provide the ability for vehicles to change directions within the subdivision. The 200-foot diameter of each development circle and the 100-foot diameter of each traffic circle provide automatic speed control for vehicular traffic. The buildings in the center vertical row (1,2,3) of FIG. 1 show a single-family detached style of home construction. The three buildings in the left, (4,5,6) and the right (7,8,9) vertical rows of FIG. 1 show an attached residential or office, commercial or industrial style of construction.

Each street in FIG. 1 is a one-way street alternating directions in a North-South orientation (10,11,12,13) and in an East-West orientation (14,15,16,17). Each one-way street has a parking lane nearest to the development circles and a traffic lane next to the parking lane. In the United States traffic would flow clockwise (18,19,20,21) around the larger development circles and would flow counter-clockwise (22, 23,24,25) around the smaller traffic circles that also provide screening.

For simplicity an entrance-exit has been shown only at the West end (26) of the subdivision in FIG. 1, although a similar entrance-exit could be added at any other edge of the subdivision.

CIRCULAR SUBDIVISIONS® residential subdivisions eliminate virtually all of the problems described above with respect to linear subdivisions. In a CIRCULAR SUBDIVISIONS® single-family detached home residential subdivision:

- There are only four homes on each development circle and each home faces 90 degrees away from the home on either side of it. Even for a minimal 5,000 square foot lot the street frontage is over 125 feet. There is room for four front street guest parking spaces and the garage doors are on the side, not the front, of the home.
- The streets are one-way only, which helps to reduce the developer's costs of land, grading, paving and draining for the streets; and
- The streets are all circular, which automatically limits the speeds of cars and trucks and would reduce deadly automobile accidents by about 90 percent according to a recent report published in the April 2001 issue of the American Journal of Public Health.

Figure 6:
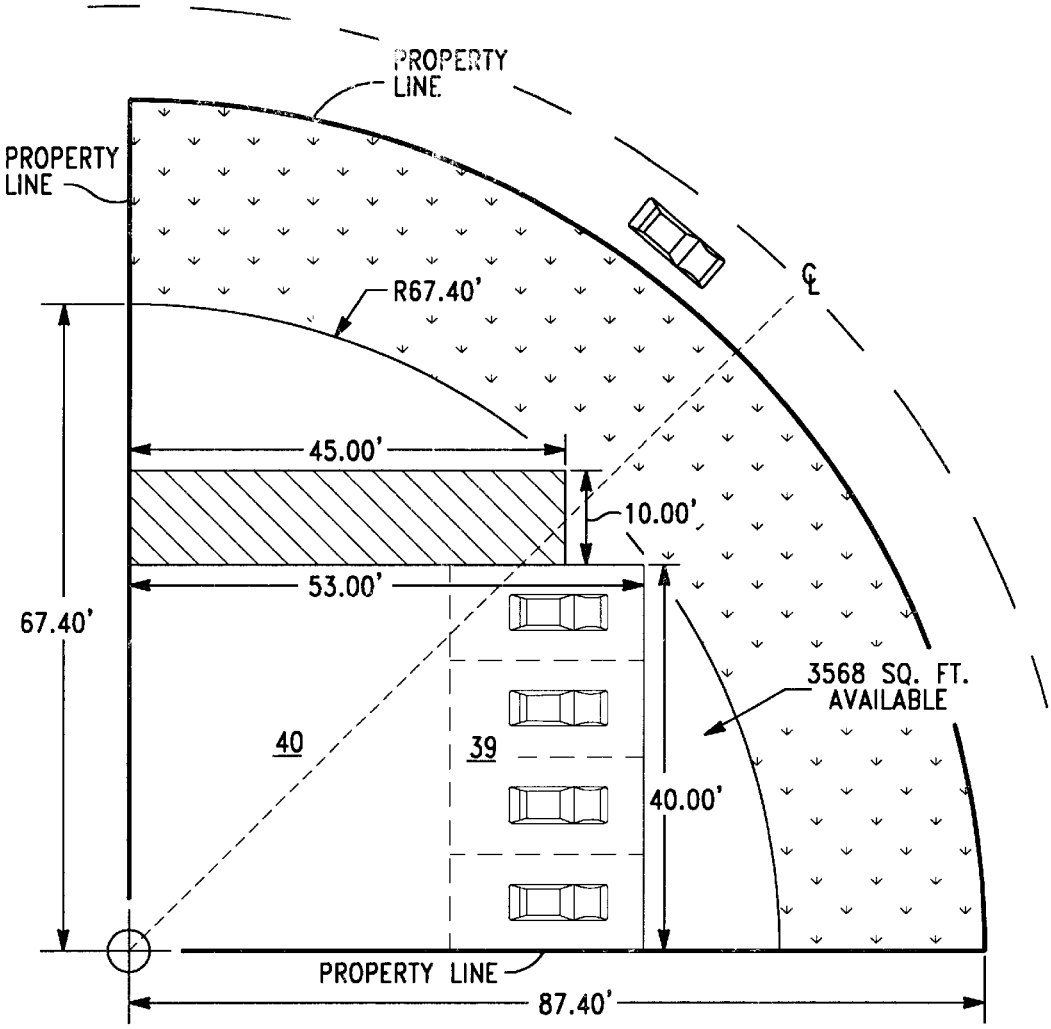
FIG. 6—Depicts a 6,000 square foot quadrant lot with a 800 square foot four car garage and about 3,440 square feet of living space in a two story attached single-family home.

CIRCULAR SUBDIVISION® single-family or multiple-family attached home residential subdivisions would have all of the advantages of a CIRCULAR SUBDIVISION® single-family detached home residential subdivision and would have the additional advantage that the same-sized development circle for four detached single-family homes would accommodate eight, or in some cases even sixteen, multiple-family attached homes (See FIG. 6).

Most office or commercial subdivisions today consist of "big box" buildings surrounded by endless of rows of 90 degree parking spaces. CIRCULAR SUBDIVISIONS® replace the "big box" buildings with smaller buildings in landscaped development circles:

- That eliminate the distant rows of 90 degree parking spaces; and
- Each building is immediately surrounded by a single row of 45 degree parking spaces, which customers clearly prefer.

The following numbered paragraphs discuss in more detail the various subjects referred to in the foregoing summary of The Concept, i.e., single-family detached homes, single-family and multiple-family condominium type homes and office, commercial and industrial subdivisions.

2. Single-Family Detached Homes

The principal objection to today's typical linear residential subdivisions is that the homes are jammed too close together. Side yard setbacks are minimal, and roof overhangs are often allowed to protrude several feet into the setback. The net result is to cause the adjacent roof overhangs almost to touch each other. CIRCULAR SUBDIVISIONS® create much greater street frontages and setback frontages on the same sized lots, thereby permitting much greater side yard setbacks between the homes.

| Lot Size (Square Feet) | Linear Lot Width at Steet | Circular Lot Width at Street | Linear Lot Width at 20' Front Setback | Circular Lot Width at 20' Front Setback |
|---|---|---|---|---|
| 4,000 | 40.00' | 112.09' | 40.00' | 80.68' |
| 5,000 | 50.00' | 125.33' | 50.00' | 93.92' |
| 6,000 | 60.00' | 137.29' | 60.00' | 105.88' |
| 7,000 | 70.00' | 148.30' | 70.00' | 116.88' |
| 8,000 | 80.00' | 158.53' | 80.00' | 127.12' |

Figure 2:
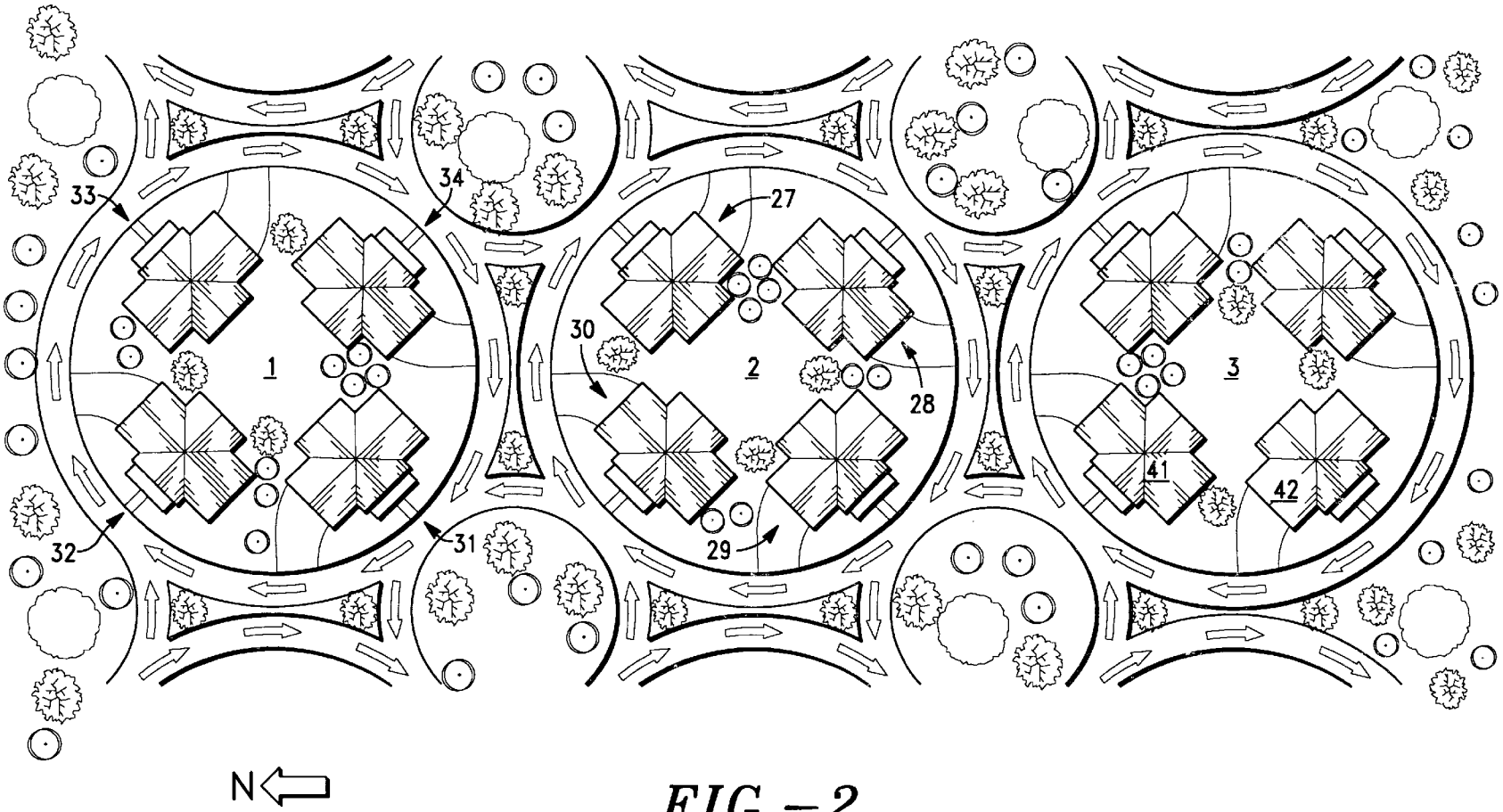
FIG. 2—Depicts the central row of development circles on the scale model, each of the three development circles containing four two story detached single-family homes.

FIG. 2, the picture of the central row (1,2,3) of the development circles on the scale model, shows not only the wider lot widths possible in CIRCULAR SUBDIVISIONS® but also the additional side yard setbacks which occur because of the orientation of detached homes in CIRCULAR SUBDIVISIONS®. Each of the four homes in a detached home development circle faces directly toward one of the four wooded traffic circles that surround the development circle, 90 degrees away from the home on either side of it. Each of the lots is a 90 degree quadrant of the development circle and its home faces in the direction of the center line of its quadrant, i.e., 45 degrees away from either of the sides of the lot. This means that adjacent homes touch the side yard setback lines only at their rear corners and the distance between the homes increases as you go toward the fronts of the homes. This additional distance between the homes further increases the feeling of openness and spaciousness in CIRCULAR SUBDIVISIONS®:

| Lot Size (sq ft) | Side Yard Setback | Space Between Rear Corners | Space Between Front Corners | Number of Garages & Living Area (sq ft) |
|---|---|---|---|---|
| 4,000 | 5.00' | 10.00' | 38.20' | 2 - 1,660 |
| 5,000 | 7.50' | 15.00' | 43.36' | 2 - 2,195 |
| 6,000 | 7.50' | 15.00' | 47.52' | 2 - 2,900 |
| 7,000-1 | 7.50' | 15.00' | 57.84' | 3 - 2,788 |
| 7,000-2 | 7.50' | 15.00' | 50.76' | 2 - 3,808 |
| 8,000 | 7.50' | 15.00' | 64.44' | 3 - 4,338 |

Not only do the larger lot widths and the orientation of homes in a CIRCULAR SUBDIVISION® create a feeling of more openness and spaciousness, they also permit garages to be entered at the side of the home (27,28,29,30), eliminating the other principal objection to linear subdivisions, that when you drive through a linear subdivision the main thing you see is a long line of garage doors facing the street. CIRCULAR SUBDIVISIONS® eliminate garage doors facing the street and permit the return to long front porches (31,32,33,34) and a feeling of community in the neighborhood.

I assumed that CIRCULAR SUBDIVISIONS® homes would be required to have a typical 20 foot front yard setback, and instructed my CAD Design contractor to do so in his drawings. Subsequently, however, I have discussed this issue with several planning departments and have found that, because the distance from one CIRCULAR SUBDIVISIONS® home to the home opposite it is screened by a traffic circle planted with trees and is at least twice the distance away from its opposite home as homes on the opposite sides of a two-way street in a rectangular subdivision, communities may require only a 10 foot front yard setback in CIRCULAR SUBDIVISIONS® detached residential subdivisions. This is a positive factor because sliding the home 10 feet forward would significantly increase the size of the back yard. Similarly, because of the facts shown in the tables at the end of the third preceding paragraph, i.e., that the front corners of detached homes in a CIRCULAR SUBDIVISION® are much further apart than the rear corners of such homes, communities may require only 5 foot side yard setbacks, instead of customary 7.5 foot side yard setbacks, in CIRCULAR SUBDIVISIONS® detached residential subdivisions.

Figure 3:
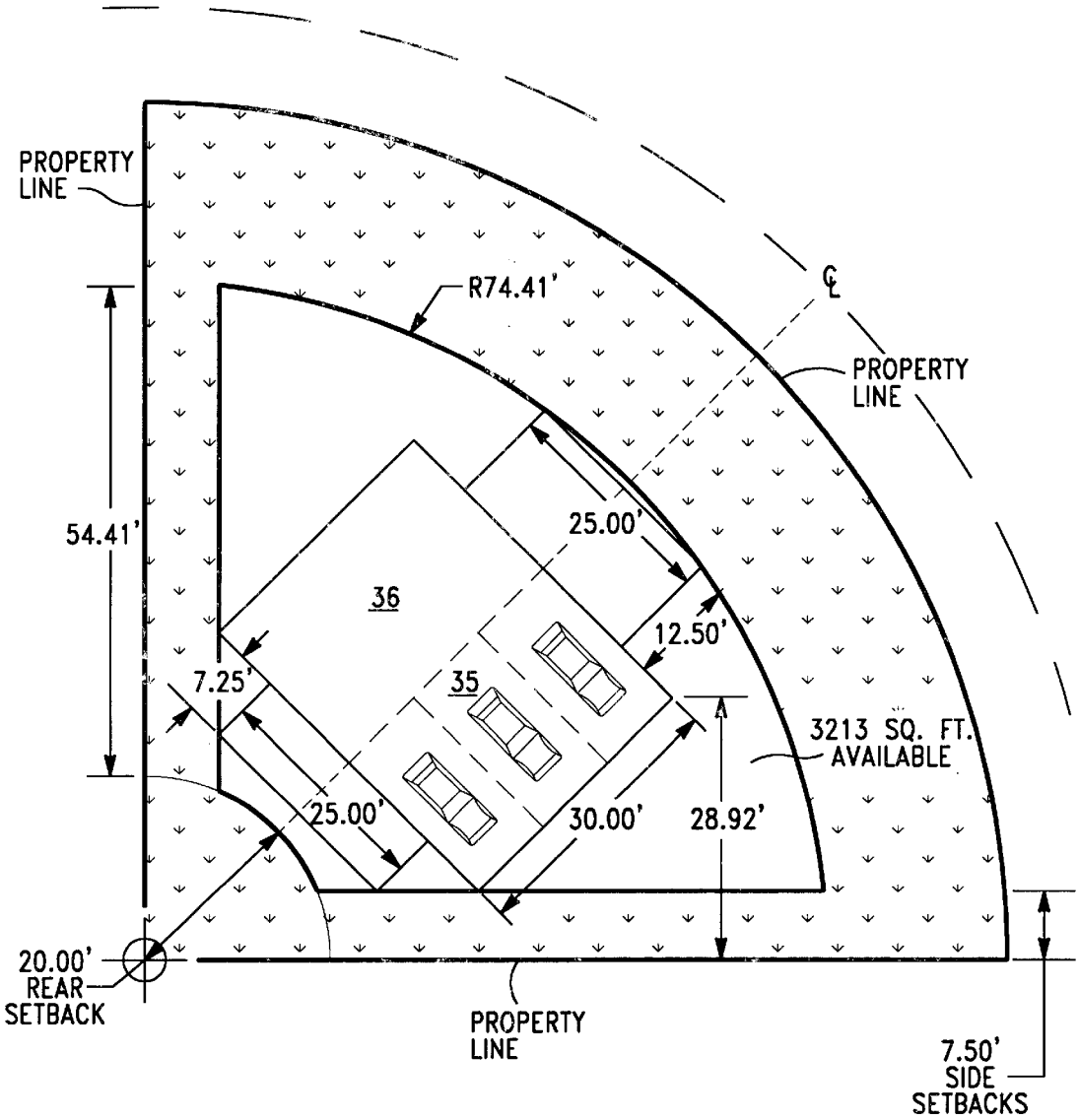
FIG. 3—Depicts a 7,000 square foot quadrant lot with a 600 square foot three car garage and about 2,788 square feet of living space in a two story detached single-family home.
Figure 4:
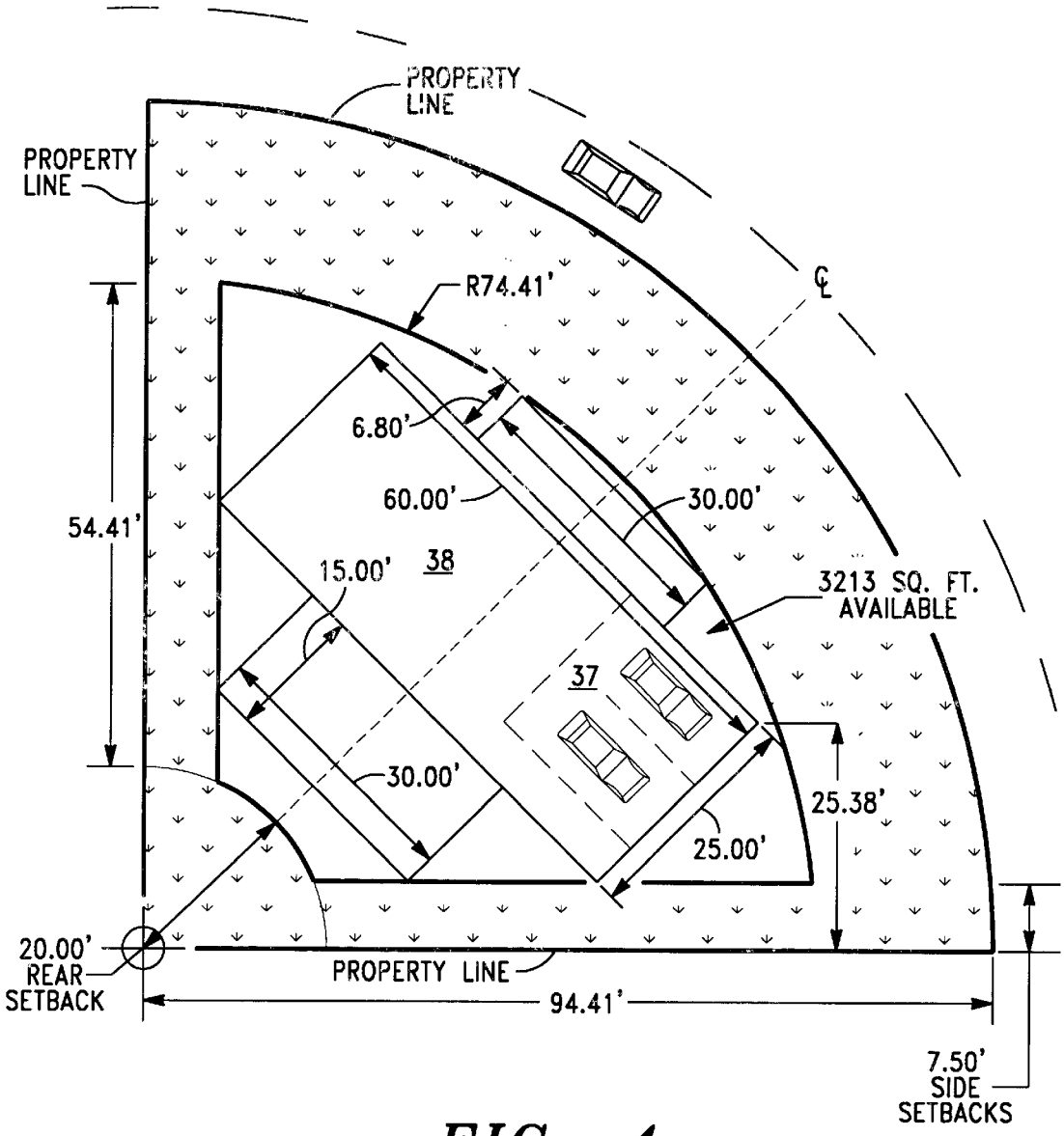
FIG. 4—Depicts a 7,000 square foot quadrant lot with a 500 square foot two car garage and about 3,808 square feet of living space in a two story detached single-family home.

FIG. 3 and FIG. 4, the "stick figure" drawings of two alternative homes for a 7,000 square foot quadrant lot provide an interesting comparison. The first drawing, FIG. 3, shows that a two story single-family detached home with a three-car garage (35) and about 2,788 square feet of living space (36), creates a considerably larger 57.84 feet of space between the front corners of adjacent homes. The second drawing, FIG. 4, shows that a two story single-family detached home with a two-car garage (37) and about 3,808 square feet of living space (38), a smaller garage and a larger amount of living space than FIG. 3, creates only about 50.76 feet of space between the front corners of adjacent homes. In a society that counts the number of garage spaces available to determine the number of apartments, or the square footage of office space, or the square footage of commercial space, that can be built on a given lot, developers have to become experts at guessing the number of garage spaces that their prospective home purchasers will need. Middle-aged couples with teen-age children probably will need more garage spaces than young couples with small children or older couples whose children have left home. CIRCULAR SUBDIVISIONS® make it easy to supply the needs of prospective home purchasers who seek three, or even four, garage spaces in a moderately priced home.

FIG. 3, that shows a home with a three-car garage (35); and about 2,788 square feet of living space (36) in a two story single-family detached home, is located on a 7,000 square foot quadrant lot. FIG. 6, referred to in the separate discussion below about Condominium Type Homes, shows a home with a four-car garage (39) and about 3,440 square feet of living space (40) in a two story single-family attached home (more garages and more living space than the home in FIG. 3), is located on a smaller 6,000 square foot quadrant lot.

In many cities the normal minimum lot size is 6,000 square feet, with smaller, sometimes down to 5,000 square foot, lots being permitted under special circumstances. FIG. 2, the picture of the central row of the scale model, depicts three development circles (1,2,3) each with four 7,854 square foot lots. Each lot contains a detached two story single-family home with about 4,416 square feet of living area (41) plus a three-car garage (42). The home footprint occupies about 2,528 square feet, leaving the home with a private yard of about 5,326 square feet and 157 feet of street frontage, enough to park at least six guest cars. The opposite home is about 180 feet away, about 60% of the length of an entire football field and about twice the distance in a rectangular subdivision, and furthermore this doubly distant view is screened by a 100-foot circle of trees located equally between the two opposite homes in a CIRCULAR SUBDIVISION®. From a development standpoint this example will produce only about 3.0 single family detached homes per gross acre of land in the subdivision. However, more typical smaller homes with two car garages would produce the following approximate densities of detached homes per gross acre of land:

| Lot size | Living Area of Home | Homes per Acre |
|---|---|---|
| 6,000 sq. ft. | 2,900 sq. ft. | 3.7 |
| 5,000 sq. ft. | 2,050 sq. ft. | 4.3 |
| 4,000 sq. ft. | 1,660 sq. ft. | 5.1 |

Figure 5:
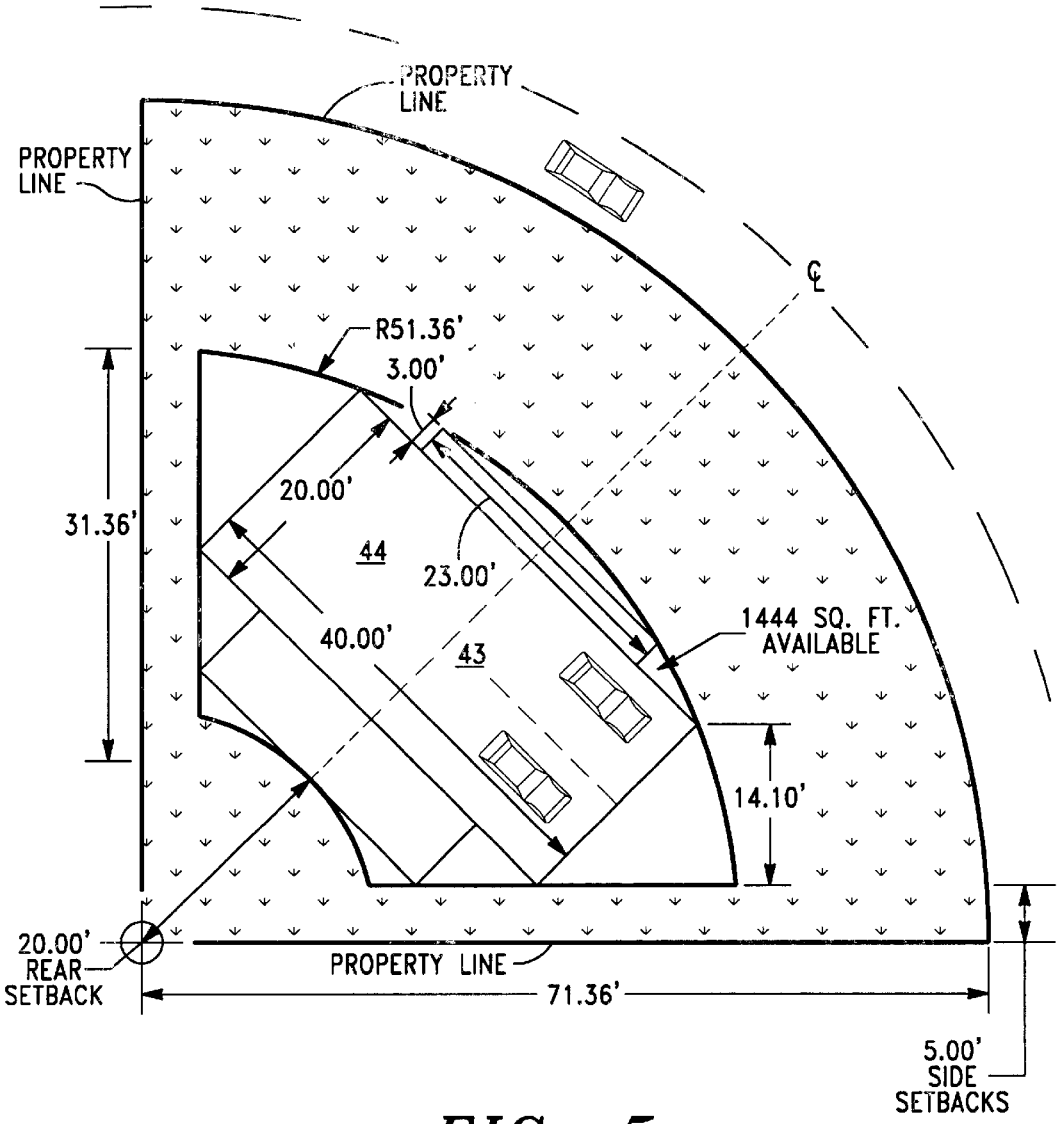
FIG. 5—Depicts a 4,000 square foot quadrant lot with a 400 square foot two car garage and about 1,660 square feet of living space in a two story detached single-family home.

FIG. 5 depicts a much smaller than normally allowed 4,000 square foot lot that contains a detached two story single-family home with a two-car garage (43) and about 1,660 square feet of living area (44). The home footprint occupies about 1,030 square feet, leaving the home with a private yard of about 3,470 square feet and over 112 feet of street frontage, more than enough to park four guest cars. The opposite home is about 125 feet away, about 42% of the length of an entire football field, and this distant view is screened by an about 60-foot circle of trees located equally between the two homes. From a development standpoint this example will produce about 5.1 single-family detached homes per gross acre of land in the subdivision. The 5.1 homes per acre for 4,000 square foot lots is an almost 19% increase in density over the more typical 4.3 homes per acre for 5,000 square foot lots discussed in the preceding paragraph.

Of particular interest to prospective home purchasers who are young couples with small children is the emphasis in CIRCULAR SUBDIVISIONS® upon traffic safety. The circular designs of the one-way streets automatically reduce the speeds of vehicular traffic, and the curbed and planted street dividers (called "dog bones" because of their shapes) prevent dangerous and illegal u-turns on the streets. Most importantly the traffic circles dramatically reduce the number of accidents that now occur in today's typical linear subdivisions that have rectangular street intersections.

A recent article by Richard A. Retting of the Insurance Institute for Highway Safety in the April 2001 issue of the American Journal of Public Health points out that "nearly half of all motor vehicle crashes that result in injuries occur at intersections" and concluded that in situations where twenty-four street intersections in eight states in the United States previously controlled by stop signs or traffic signals were converted to modern traffic circles, referred to as roundabouts, vehicular traffic accidents were reduced by 38% for all accidents; and by 76% for accidents causing injury; and by almost 90% for accidents causing death or incapacity.

These dramatic improvements in traffic safety, compared to today's typical linear subdivisions with rectangular street intersections, certainly will appeal to prospective home purchasers who are young couples with small children, but also will appeal greatly to the governmental staff members, and the elected governmental officials, who have to approve new subdivisions and are often named as defendants in court litigation involving collisions at the current rectangular street intersections.

While the principal function of CIRCULAR SUBDIVISIONS® probably will be to make smaller lots appear larger and more private, CIRCULAR SUBDIVISIONS® lots will also appeal to medium and large lot subdivision developers. Medium sized lots will also have the larger and more private appearance but will permit the addition of larger amenities such as swimming pools, sports courts, etc.

Large lot subdivision developers have a unique opportunity with CIRCULAR SUBDIVISIONS®. Developers of lake properties will confirm that a private island as a lot will command a premium price. The same is true in CIRCULAR SUBDIVISIONS®. A single development circle with a 200 foot diameter contains about three-quarters of an acre and can accommodate a large home with the windows on each of its four sides facing one of the four traffic circles which surround the development circle, thereby creating a private island effect.

3. Single-Family and Multiple-Family Condominium Type Homes

The left (4,5,6) and right (7,8,9) vertical rows in FIG. 1, the picture of the entire scale model, show 200-foot diameter development circles, each containing four 30 foot by 50 foot two story offset-star single family condominium type homes. Each home contains a three-car garage (45) and 2400 square feet of living area (46). The four lots in the development circle each contain 7,854 square feet. The footprint of each home occupies 1,500 square feet, leaving each home with a private yard of 6,354 square feet and 157 feet of street frontage, more than enough to park six guest cars. To insure privacy within the development circle, each home has windows viewing only in the same two directions as the front door, and the garage doors, of the home. The opposite home would be about 280 feet away, over 93% of the length of a football field, and this distant view would be screened by an about 100-foot diameter circle of trees located equally between the two homes If you look closely at FIG. 1, the picture of the entire scale model, you can see that, in the left and right vertical rows, there are four rectangular buildings centered on the exact center point of the radius of the development circle (47). This form of construction is generally called off-set star, pinwheel or triple-zero lot line construction, and is probably the most cost-efficient method of construction for CIRCULAR SUBDIVISIONS®. Just as the ends of the blades of a pinwheel are always the same distance from the metal pin that holds them together, the ends of each building in an off-set star constructed group of four buildings is the same distance from the center point of the radius of the development circle under the buildings. This concentration of buildings at the center of a development circle that has only a 100-foot radius allows each home in the group to be about 280 feet away from its opposite home, more than 93% of the length of a football field, and this distant view is screened by an almost 100-foot diameter circle of trees located equally between the two opposite homes.

The group of four such buildings need not be developed as condominiums, although they could be. Each building is separate and is located on a separate quadrant lot of the development circle. Each lot and building could be developed as a separate fee title, with appropriate easements for support and maintenance of the overlapping roof areas.

The increased approximate densities of single-family homes per gross acre of land for off-set star, pinwheel or triple-zero lot line homes over detached homes can be demonstrated by this schedule:

| Lot Size | Detached Garages | Detached Living Area | Detached Density | Pin-wheel Garages | Pin-wheel Living Area | Pin-wheel Density |
|---|---|---|---|---|---|---|
| 4,000 | 2 | 1,660 | 5.1/A | 2 | 1,480 | 10.2/A |
| 5,000 | 2 | 2,195 | 4.3/A | 3 | 2,400 | 12.9/A |
| 6,000 | 2 | 2,900 | 3.7/A | 4 | 3,440 | 14.8/A |
| 7,000-1 | 3 | 2,788 | 3.3/A | 4 | 4,000 | 13.2/A |

-continued

| Lot Size | Detached Garages | Detached Living Area | Detached Density | Pin-wheel Garages | Pin-wheel Living Area | Pin-wheel Density |
|---|---|---|---|---|---|---|
| 7,000-2 | 2 | 3,808 | 3.3/A | 4 | 4,000 | 13.2/A |
| 8,000 | 3 | 4,388 | 2.9/A | 4 | 4,800 | 11.6/A |

4. Office, Commercial or Industrial Developments

CIRCULAR SUBDIVISIONS® are particularly well suited to office, commercial or industrial developments. An approximately 182 foot diameter development circle allows about 64 nine foot 45 degree angle parking spaces. Typical zoning codes allow about 250 square feet of office or commercial development for each parking space, and 64 parking spaces would support about 16,000 square feet of office or commercial development. The development circle would contain about 26,016 square feet of area, so a one-story 16,000 square foot commercial building would result in only 61.5% lot coverage, and the remaining 38.5% could be developed into attractively landscaped outdoor patios, etc. A two-story 16,000 square foot office building would decrease the lot coverage to 30.75% and would increase to 69.25% the amount of open space to be developed into attractively landscaped outdoor patios, etc. Industrial zoning codes are generally even more favorable to developers.

In office or commercial developments the main concern is not privacy, but visibility. Giant retailers such as Wal-Mart, Sears, Target, etc., can achieve the 100,000 square feet of "big box" retail space they currently occupy by acquiring six adjacent development circles, each with a 16,000 square foot building selling functionally related products. Customer parking would be right next to the buildings, eliminating the endless seas of asphalt parking lots that are used today. The four smaller traffic circles surrounding each of the larger office or commercial circles provide the same natural screening discussed with respect to residential development, and they also could be used in part to provide amenities for customers. From a development standpoint this example will produce about 11,800 square feet of office or commercial building development per gross acre of land in the center and will require substantially less of the normal costs of land, grading and paving required for the parking lot in a typical office or commercial center.

I do not intend to develop any CIRCULAR SUBDIVISIONS® myself. The best mode contemplated by me of carrying out my inventions will be to enter into non-exclusive license agreements with both small and large capable professional residential, office, commercial and industrial developer-builders.

What I claim as my invention is:

1. A subdivision system providing alternating one-way traffic on all subdivision streets, said system comprising, a plurality of traffic circles, each traffic circle having a traffic lane surrounding the traffic circle, a plurality of development circles, each development circle containing one or more buildings, each development circle having an inner parking lane, and an outer traffic lane, surrounding the development circle, the rotational direction of traffic flow around a traffic circle being opposite to the rotational direction of traffic flow around a development circle, wherein certain parts of the traffic lane of each traffic circle overlap certain parts of the traffic lanes of at least two immediately adjacent development circles, and wherein said certain overlapping parts of the traffic lanes of the traffic circles, and the opposite rotational directions of traffic flow around the traffic circles and around the development circles, provide alternating one-way traffic on all subdivision streets.

2. The system defined in claim 1 wherein, as viewed from above the system, the traffic around the development circles proceeds clockwise and the traffic around the traffic circles proceeds counter-clockwise.

3. The system defined in claim 1 wherein, as viewed from above the system, the traffic around the development circles proceeds counter-clockwise and the traffic around the traffic circles proceeds clockwise.

4. The system defined in claim 1 wherein entrances into, and exits from, the subdivision comprise parallel curved one-way traffic lanes separated by curbed and planted traffic lane dividers.

5. The system defined in claim 1 wherein entrances into, and exits from, the subdivision comprise mirror-image curved one-way traffic lanes separated by curbed and planted traffic lane dividers.

6. The system defined in claim 1 wherein entrances into, and exits from, the subdivision comprise parallel straight one-way traffic lanes separated by curbed and planted traffic lane dividers.

7. The system defined in claim 1 wherein the peripheral one-way streets are proceeding tangentially in a curved line, having radii equal to the radii of the streets surrounding the traffic circles in the subdivision, from the outer edge of the traffic lane surrounding a development circle to the outer edge of the traffic lane surrounding the adjacent development circle.

8. The system defined in claim 1 wherein the peripheral one-way streets are proceeding tangentially in a straight line from the outer edge of the traffic lane surrounding a development circle to the outer edge of the traffic lane surrounding the adjacent development circle.

9. The system defined in claim 1 wherein the spaces between the central outer edges of the traffic lanes surrounding adjacent development circles are being separated by curbed and planted traffic dividers called dog bones because of their shapes.

10. The system defined in claim 1 wherein lots are consisting of quadrants of a development circle, with the centerline of each such quadrant pointed toward the center of such quadrant's adjacent traffic circle.

11. The system defined in claim 1 wherein the radius of the circle forming the inner edge of the parking lane is reduced, increasing the width of the parking lane and correspondingly reducing the area of the development circle, providing for appropriate angular rather than parallel vehicular parking, thereby permitting office, commercial, industrial and more dense residential usage of the remaining portion of the development circle.

12. The system defined in claim 1 wherein the circles are circular in configuration.

13. The system defined in claim 1 wherein the circles are elliptical in configuration.

14. The system defined in claim 1 wherein the circles are polygonal in configuration.

* * * * *